US006938445B2

(12) United States Patent
Huang

(10) Patent No.: US 6,938,445 B2
(45) Date of Patent: Sep. 6, 2005

(54) MORTISE LOCK STATUS INDICATOR

(75) Inventor: Richard Hai Huang, West Haven, CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 10/400,987

(22) Filed: Mar. 26, 2003

(65) Prior Publication Data

US 2004/0187533 A1 Sep. 30, 2004

(51) Int. Cl.[7] ..... E05B 59/00; E05B 63/14; E05B 41/00

(52) U.S. Cl. ..... 70/107; 70/432; 70/DIG. 59

(58) Field of Search ..... 70/107, 432, DIG. 59

(56) References Cited

U.S. PATENT DOCUMENTS

| | | | | | |
|---|---|---|---|---|---|
| 343,376 | A | * | 6/1886 | Hutson | |
| 747,252 | A | | 12/1903 | Smith | |
| 871,126 | A | * | 11/1907 | Lockett | |
| 943,637 | A | | 12/1909 | Schoell | |
| 999,044 | A | | 7/1911 | Kuster | |
| 1,216,899 | A | | 2/1917 | Weyer | |
| 1,337,401 | A | | 4/1920 | Heberling | |
| 1,362,647 | A | | 12/1920 | Stone et al. | |
| 1,529,766 | A | * | 3/1925 | Bina | |
| 1,898,127 | A | * | 2/1933 | Hershey | |
| 2,565,669 | A | | 8/1951 | Smith | |
| 2,784,993 | A | * | 3/1957 | Collar | |
| 3,126,218 | A | * | 3/1964 | Andrews | |
| 3,304,756 | A | * | 2/1967 | Eads | |
| 3,631,695 | A | * | 1/1972 | Velbert et al. | 70/432 |
| 4,067,599 | A | | 1/1978 | Ohno | 292/356 |
| 4,312,198 | A | | 1/1982 | Sedley | 70/276 |
| 4,490,999 | A | | 1/1985 | Castle et al. | 70/432 |
| 4,559,796 | A | | 12/1985 | De Forrest, Sr. | 70/432 |
| 4,583,382 | A | | 4/1986 | Hull | 70/107 |
| 4,776,614 | A | | 10/1988 | Marrison et al. | 285/87 |
| 4,936,896 | A | * | 6/1990 | Takatsuka | 70/432 |
| 5,235,833 | A | * | 8/1993 | Pinto | 70/471 |
| 5,548,984 | A | | 8/1996 | Miyatsu | 70/276 |
| 5,595,080 | A | | 1/1997 | Whinton | 70/432 |
| 5,678,870 | A | | 10/1997 | Pelletier | 292/244 |
| 6,253,273 | B1 | | 6/2001 | Blumenau | 710/200 |
| 6,282,929 | B1 | | 9/2001 | Eller et al. | 70/109 |
| 6,354,122 | B1 | * | 3/2002 | Snoke | 70/432 |
| 6,398,274 | B1 | | 6/2002 | Huang et al. | 292/358 |

FOREIGN PATENT DOCUMENTS

| | | | | |
|---|---|---|---|---|
| BE | 562983 | * | 12/1957 | 70/432 |
| CA | 636763 | * | 2/1962 | 70/432 |
| CH | 379945 | * | 9/1964 | 70/432 |
| GB | 1119407 | * | 7/1968 | 70/432 |
| GB | 1583079 | * | 1/1981 | 70/432 |

* cited by examiner

*Primary Examiner*—Lloyd A. Gall
(74) *Attorney, Agent, or Firm*—DeLio & Peterson, LLC

(57) ABSTRACT

A conventional mortise lock is provided with a visual status indicator to show whether the room is occupied or vacant. The mortise lock output, which operates the deadbolt, is used to linearly move an indicator slide positioned on the outside of the door by a rotating indicator spindle which is in communication with the mortise lock output and indicator slide. The visual status indicator has an opening which is covered by a transparent high strength, impact resistant material such as LEXAN plastic. A preferred embodiment combines the outer lever door handle controller and visual status indicator in a single housing.

5 Claims, 4 Drawing Sheets

OUTSIDE OF DOOR
INSIDE OF DOOR 30
32
34
40
42
44
45
50
52
58
59
60
61
62
64
66
72
74
84
86
88
89
92
94
102
104
108
110
46

MORTISE LOCK STATUS INDICATOR

BACKGROUND OF THE INVENTION

1. Field of the Invention

The present invention relates to mortise locks and, in particular, to a high security and tamper proof visual indicator mounted on the outside of the door and in communication with the lock to indicate whether the door is locked or unlocked.

2. Description of Related Art

Mortise locksets generally include the mortise lock and inner and outer handle controllers or trim sets which operate the mortise lock. The mortise lock is mortised into the door and usually includes the latching mechanism which secures the door to the doorframe when the door is closed, as well as the locking mechanism which prevents the latching mechanism from being retracted when the door is locked.

The handle controllers are generally surface mounted on opposite sides of the door and have handles which operate the latching mechanism. In most current designs, the handle on each handle controller is directly connected to a shaft that extends into the mortise lock. The handle controllers also typically have some means of operating and controlling the lock mechanism in the mortise lock.

The outer surface of the door will have a key-operated lock cylinder having a tail that extends through the door skin and into the mortise lock through the surface of the door. Turning the key rotates the lock cylinder tail cam which operates the locking mechanism within the mortise lock to lock it and prevent the handle from being turned.

In mortise lock designs of this type, the lock cylinder (or similar mechanical or electrical lock device) will connect (via the lock cylinder tail cam) to a lock input on the mortise lock. The lock input connects to and operates the locking mechanism within the mortise lock. The shaft extending from the handle connects to a handle input on the mortise lock to retract the latch bolt in the mortise lock when the mortise lock is not locked.

Locking the mortise lock will normally block rotation of the handle input or associated linkages between the handle input and the latching mechanism. Locking will also normally extend the deadbolt. When the mortise lock mechanism is not locked, with the deadbolt retracted, rotation of the handle input will retract the latch bolt and allow the door to be opened.

The handle input and the lock input are normally operable from either face of the mortise lock. This allows the mortise lock to be installed in both left and right hand hinged doors. These inputs are engaged by corresponding shafts or members that extend out of the back of the handle controllers and through openings in the face of the door. The handle input is usually driven by the handle shaft and the lock input by the tail cam on the lock cylinder. This design also allows the inner handle controller to share the handle input with the outer handle controller so that either handle may operate the door.

An indicator on the outer surface of the door is known to show whether the door is locked (room occupied) or unlocked (room vacant). Such indicator locks are employed in hotel rooms and the guest may turn a thumb turn on the inside of the door to lock the door and to operate a signal mounted on the outer handle controller which shows whether the room is occupied or vacant. Such indicator products currently on the market, however, do not have the required security and can be easily tampered with or vandalized.

Bearing in mind the problems and deficiencies of the prior art, it is therefore an object of the present invention to provide a mortise lock having a high security and tamper proof visual indicator which shows whether the door is locked or unlocked.

Another object of the invention is to employ a combination visual indicator module and lever handle/adapter module.

Other objects and advantages of the present invention will be apparent from the following description.

SUMMARY OF THE INVENTION

The above and other objects, which will be apparent to those skilled in art, are achieved in the present invention which is directed to a mortise lock having a high security and tamper proof visual status indicator which shows whether the door is locked or unlocked comprising:

a door;

a mortise lock positioned in the door comprising outer and inner handles for extending or retracting a latch, a mortise lock input for changing the mortise lock from an unlocked to locked position employing a deadbolt and a mortise lock output in communication with the lock input for extending or retracting the deadbolt;

a visual indicator comprising a rotatable indicator spindle and an indicator slide wherein one end of the spindle is inserted in the mortise lock output and the other end is in communication with the indicator slide which moves linearly in response to the rotation of the indicator spindle when the door is locked or unlocked and which shows whether the door is locked or unlocked through an opening in the indicator.

The mortise lock to be controlled is conventional and has a latch and outer and inner handles for extending or retracting the latch, a lock for changing the mortise lock from an unlocked to a locked condition employing a deadbolt and a deadbolt throw lever. The invention comprises using the lock and/or deadbolt throw lever for outputting the unlocked or locked condition of the mortise lock to a visual indicator. The visual indicator of the invention is mounted on the outside of the door and includes a body, a rotatable indicator spindle in communication with the lock output of the lock, an arcuate plate in communication with the indicator spindle and movable in an arc when the indicator spindle rotates and an indicator slide which moves linearly with the rotating indicator spindle and arcuate plate. The indicator slide shows whether the room is occupied or vacant.

A preferred mortise lock employs a combination visual status indicator module and lever handle/adapter module.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–6B of the drawings in which like numerals refer to like features of the invention.

Figure 1:
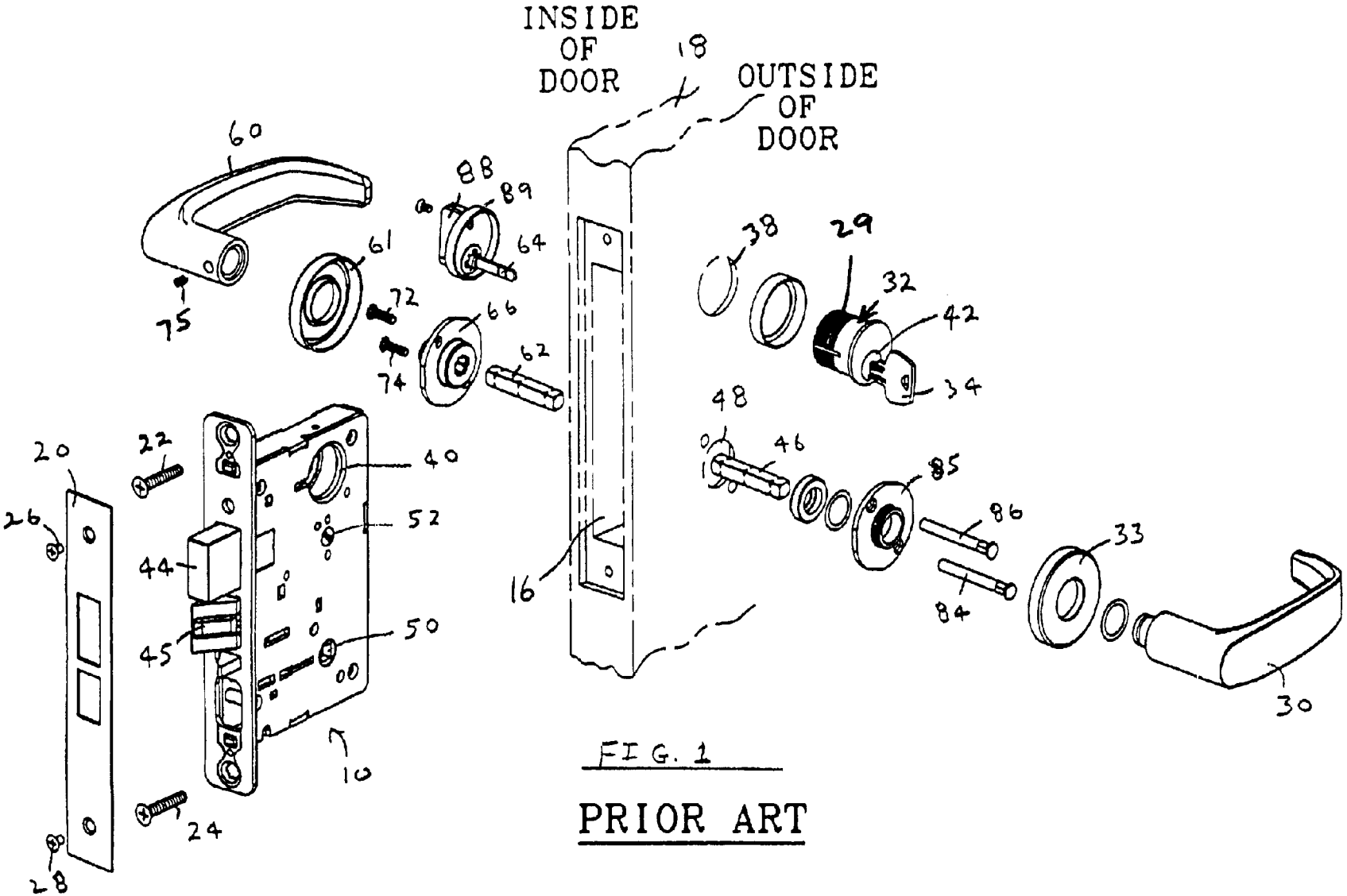
FIG. 1 PRIOR ART
FIG. 1 is a perspective view of a prior art disassembled conventional mortise lockset, including a mortise lock, an inner lever handle and a deadbolt throw lever, an outer lever handle and a lock cylinder in communication with the mortise lock showing the relative placement of the mortise lockset components and the door (shown in phantom), prior to installation.

Referring to FIG. 1, a conventional mortise-type lockset of the prior art includes a mortise lock 10, an outer lever handle 30, and an inner lever handle 60. The mortise lock 10 fits within a mortise opening 16 in door 18 and is covered by decorative plate 20.

The mortise lock 10 is held in door 18 with screws 22, 24 and these screws are covered by the decorative plate 20 which is held onto the edge of the mortise lock 10 with screws 26, 28. The mortise lock 10, as well as the inner lever handle 60 and outer lever handle 30, are substantially unchanged from the prior art, and no modifications are needed to these elements in order to provide the mortise lock visual indicator of the invention. It is highly preferred, however, that the visual indicator and outer lever handle be combined in a single housing to make the lock easier to install and enhance its tamper resistance.

The outside of the door also includes lock cylinder 32 having a cylinder shell 29 and cylinder plug 42 operated by key 34.

There are two functional connections between the outer lever handle 30 and lock cylinder 32 of the prior art and the mortise lock 10. The first of these is the lock cylinder 32 which extends through lock cylinder opening 38 in the door and into mortise lock input 40 on the mortise lock 10. The lock cylinder 32 operates the lock input of the mortise lock 10 in exactly the method of the prior art. Rotation of key 34 turns cylinder plug 42 in lock cylinder 32 which operates a tail cam located inside mortise lock input 40. Rotation of the key 34 in one direction causes the deadbolt 44 to be extended and locks the mortise lock 10. Rotation in the opposite direction retracts deadbolt 44 and unlocks the mortise lock mechanism.

The second connection between the outer lever handle 30 and the mortise lock 10 is through the handle shaft 46 which extends through handle shaft opening 48 in the door 18 and into the handle input 50 on the mortise lock. Turning the handle 30 retracts latch 45.

The interaction of the outer lever handle 30 of the prior art and the mortise lock 10 occurs through the two connections referred to above, and may be summarized as follows. The key 34 turns the mortise lock input 40 to lock and unlock the mortise lock. When the mortise lock 10 is locked or unlocked (either through key 34 or from the throw lever blade shaft 64 of the inner handle controller), it turns the mortise lock output 52. The rotation of mortise lock output 52 retracts or extends deadbolt 44 thus opening or closing the door, respectively.

The inner lever handle 60 is substantially unchanged from the prior art. It includes an inner handle shaft 62 which extends into the opposite side of handle input 50 on the mortise lock 10. A throw lever 88 turns throw lever blade shaft 64 which extends into the mortise lock output 52 and when the deadbolt throw lever on the inside is turned, it turns mortise lock output 52 and automatically retracts or extends the deadbolt 44. The inner lever handle 60 connects to mounting adapter 66 which turns the inner handle shaft 62. The entire mechanism is assembled in a conventional manner with screws 72 and 74 and set screw 75. A decorative cover/rosette plate 61 is typically employed.

Mounting posts 84, 86 are used for alignment and strength and are through bolted through corresponding openings in mounting adapter 85 and holes in the door and mortise lock.

When the key 34 is inserted into the lock cylinder 32 and rotated, a tail cam rotates around and operates the mortise lock input 40 to lock the mortise lock in the conventional manner. This causes the lock output 52 to turn and deadbolt 44 to be retracted or extended.

When the key is rotated in the opposite direction it unlocks the mortise lock and switches the lock output to the unlocked position.

Thus, a prior art mortise lock 10, a prior art inner lever handle 60 and an outer lever handle 30 from an existing installation may be used with the visual status indicator of this invention to provide a mortise lock having a high security and tamper proof visual status indicator.

Figures 2, 3:
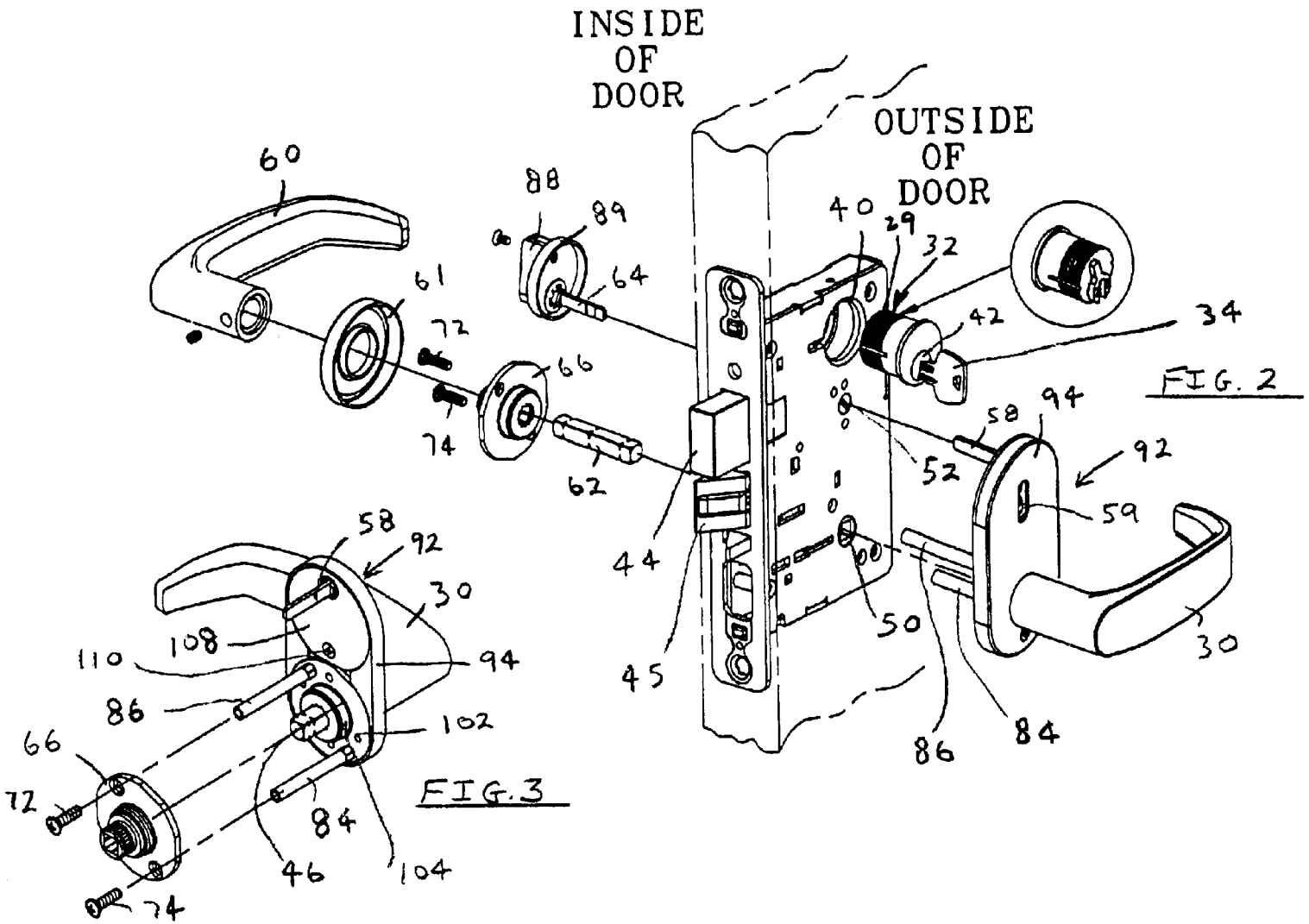
FIG. 2 is a perspective view of a disassembled mortise lockset of the invention showing a combined outer lever handle and visual indicator of the invention used with a conventional mortise lock.
FIG. 3 is a perspective view of the preferred assembled combined outer handle and visual indicator of the invention shown in FIG. 2.

FIG. 2 shows a mortise lock and visual status indicator of the invention and utilizes a conventional mortise lock as shown in FIG. 1 except for modification of the outer lever handle to accommodate visual indicator 59 and indicator spindle 58. Visual indicator 59 shows the status of the room and is shown as indicating that the room is occupied ("OCC").

FIG. 2 shows the principal elements of the inner and outer lever handle controllers and the mortise lock mechanism 10 of the present invention. It can be seen that the lock cylinder 32 will extend into the lock input 40 when assembly is complete.

The mortise lock assembly shown in FIG. 2 operates in essentially the same way as the prior art mortise lock described in FIG. 1 except for the indicator spindle 58 and indicator opening 59. As will be more fully described hereinbelow, the rotational position of the indicator spindle 58 will determine the position of an indicator slide and indicate whether the door is locked or unlocked. As can be seen, the indicator spindle 58 is received into mortise lock output 52 and will turn as the mortise lock output is turned depending on whether the door is locked or unlocked. As also can be seen from FIG. 2, the deadbolt throw lever 88 communicates with throw lever blade shaft 64 which also communicates with mortise lock output 52. Accordingly, throw lever blade shaft 64 and indicator spindle 58 are both inserted in mortise lock output 52 and will both turn in the same direction whenever mortise lock output 52 is turned. Thus, if the deadbolt throw lever 88 is turned to lock the door and extends the deadbolt 44 from the mortise case, throw lever blade shaft 64 is turning the mortise lock output. Likewise, mortise lock output 52 turns indicator spindle 58 which actuates an indicator slide within indicator opening 59 showing the status of the lock and whether the room is occupied or vacant.

Referring now to FIG. 3 an assembled combined outer lever handle controller and visual status indicator is shown. The indicator and handle assembly of the present invention is shown generally as 92 and comprises a housing 94 having rounded ends (an indicator opening 59 to show the occupancy status of the room is not shown in this view). The outer lever handle housing 92 has associated therewith the indicator spindle 58 extending outward from the rear of the housing. Indicator spindle 58 is inserted into mortise lock output 52 and will turn as the mortise lock output is turned when the door is locked or unlocked.

Figure 4:
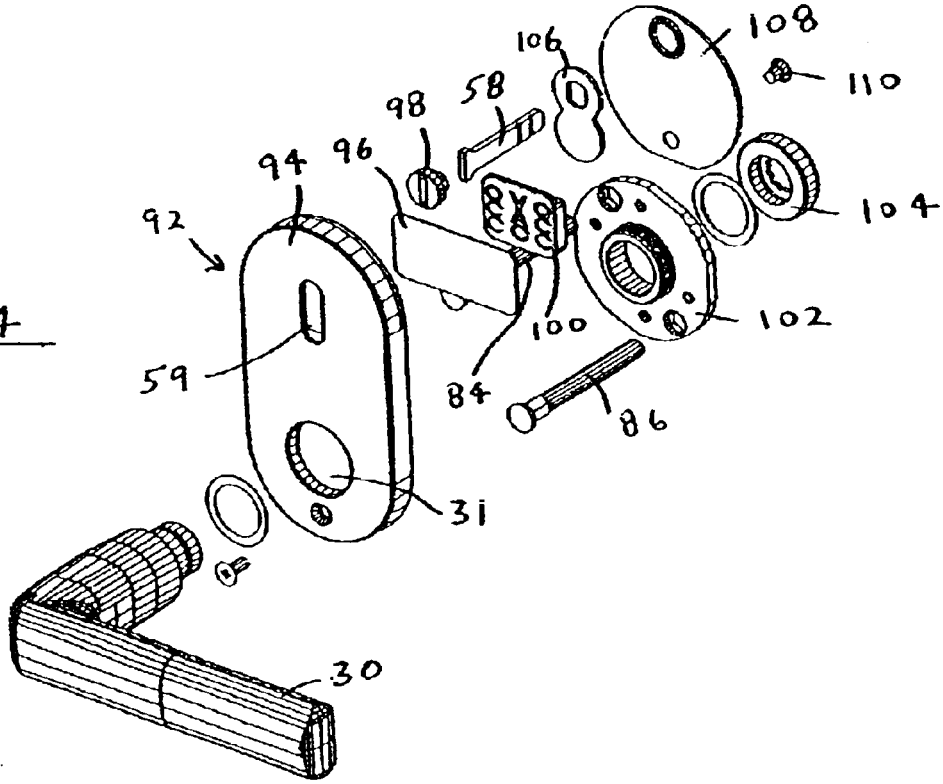
FIG. 4 is an exploded perspective view of the preferred combined outer lever handle and visual indicator of the invention shown in FIG. 3.

Referring now to FIG. 4, an exploded perspective view of the outer lever handle housing 92 is shown. The housing 92 has a body 94 with an opening 31 to accommodate the outer lever handle 30 and is conventional in using mounting posts 84 and 86 to communicate with corresponding openings in the mortise lock and door to secure the housing to the door and lock. A mounting adapter 102 is used in conjunction with cap nut 104 which holds outer lever handle 30 and housing 92 together and an outer handle spindle 46 (not shown) would communicate with mortise lock handle input 50 so that when the lever handle 30 is turned the mortise lock handle input 50 is turned actuating the latch. The upper portion of body 94 comprises an indicator opening 59, a see-through window shield 96 and a spindle hub 98 holding the indicator spindle 58. An indicator slide 100 overlies the window shield 96 and also has a hub plate 106 overlying the indicator slide 100. The indicator spindle 58 extends through an opening in the hub plate 106 and a corresponding opening in the back plate 108. The back plate 108 overlies the components and the indicator assembly is held to the body by screw 110.

Figure 5:
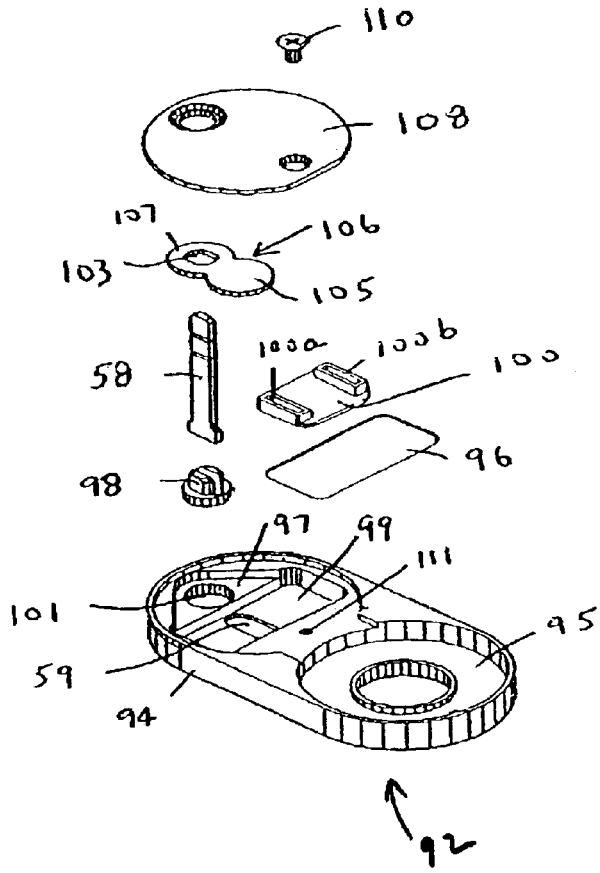
FIG. 5 is an exploded perspective plan view of the preferred combined outer lever handle and visual indicator of FIG. 4.

Referring now to FIG. 5, the outer lever handle housing 92 may be described in detail. The lower portion of the housing body 94 has a circular recess 95 to accommodate the mounting adapter 102 as is conventional. The upper portion of the body has an upper triangular recess 97 having a blind hole recess 101 therein. At the base of the triangular recess is a deeper rectangular recess 99 having an indicator opening 59 which extends through the body. To assemble the components in the housing, the spindle hub 98 is placed in blind hole recess 101 and the indicator spindle 58 placed in the spindle hub 98. The see-through window shield 96 is positioned in the rectangular recess 99 followed by the indicator slide 100. The other end of indicator spindle 58 is then passed through opening 103 in the upper portion 107 of hub plate 106 and the bottom portion 105 of hub plate placed over the indicator slide 100 and between projections 100*a* and 100*b*. The hub plate is shown in a preferred FIG. 8 configuration. The back plate 108 is then positioned over the assembly and secured to body 94 by screw 110 which is mounted into screw opening 111. The window shield 96 is preferably made from a transparent high strength, impact resistance plastic such as LEXAN and in particular, LEXAN FR-60 film. LEXAN is a polycarbonate resin and any suitable transparent material may be used as the window shield.

Figure 6A:
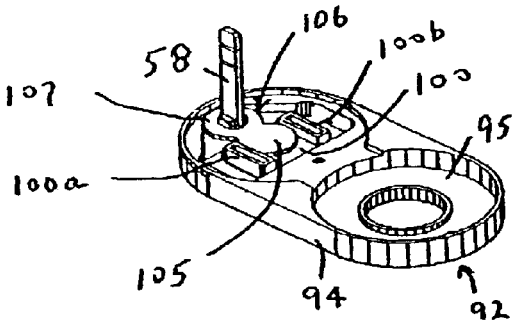
FIGS. 6A and 6B are perspective plan views of the preferred combined outer lever handle and visual indicator shown in FIGS. 4 and 5 illustrating movement of the indicator slide.
Figure 6B:
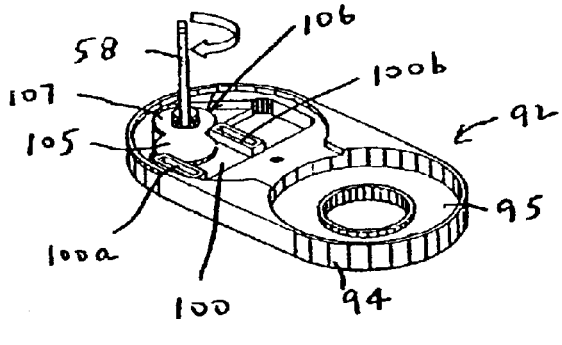

Referring now to FIGS. 6A and 6B, operation of the indicator slide housing 92 is described. In FIG. 6A the hub plate 106 is shown disposed in the body 94 along its longitudinal axis. The indicator spindle 58 is likewise shown vertically disposed. As described above the end of indicator spindle 58 is inserted into mortise lock output 52 which controls the position of the deadbolt of the mortise lock. In the position that the indicator spindle 58 is shown, the door is unlocked and the room is vacant. This will be shown in the indicator opening 59.

Referring now to FIG. 6B, the indicator spindle 58 has been turned because the mortise lock output 52 was turned either by turning the key or turning the deadbolt throw lever 88. The rotational turning of the indicator spindle 58 turns the hub plate 106 in an arc and forcing it against one of projections 100*a* and 100*b* and moving the indicator slide 100 linearly to the left. In this position, the indicator slide would indicate that the room is occupied and that the door is locked.

When a person wishes to leave the room, the deadbolt throw lever 88 would be turned, rotating the indicator spindle 58 and indicator slide 100 back to the position shown in FIG. 6A, and retracting the deadbolt and indicating that the room is now vacant.

The above indicator can also be used with any locking mechanism which would turn the indicator spindle 58. Such a locking mechanism includes a deadbolt lock, exit device, and the like.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A mortise lock having a high security and tamper proof visual status indicator to show whether a door is locked or unlocked comprising:

a door having an outside and an inside;

a mortise lock positioned in the door comprising outer and inner handles for extending or retracting a latch, a mortise lock input on the outside of the door for changing the mortise lock from an unlocked to locked position employing a deadbolt and a mortise lock output in communication with the lock input for extending or retracting the deadbolt, a deadbolt throw lever blade shaft extending from the inside of the door which shaft extends into the mortise lock output;

a visual status indicator comprising a rotatable indicator spindle axially aligned with the deadbolt throw lever, a housing having a top, bottom an right and left sides and an indicator slide in the housing wherein one end the indicator spindle is inserted in the mortise lock output and the other end is in communication with the indicator slide which slide moves linearly horizontally sideways between the right and left sides of the housing in response to the rotation of the mortise lock output and the indicator spindle when the door is locked or unlocked and which shows whether the door is locked or unlocked through an opening in the indicator.

2. The mortise lock of claim 1 wherein the indicator slide is contained in a lower rectangular recess of a body having an upper triangular recess and a lower rectangular recess, a hub plate having one end in the triangular recess and the other end in the rectangular recess, the end in the triangular recess having an opening to accommodate the indicator spindle and which spindle rotates the hub plate when the mortise lock output is rotated to lock or unlock the lock and the rotating hub plate linearly moves the indicator slide linearly horizontally sideways between the right and left sides in rectangular recess of the housing changing the visual indicator to locked or unlocked depending on the position of the deadbolt.

3. The mortise lock of claim 1 wherein the outer handle and visual status indicator are combined in a single housing.

4. The mortise lock of claim 2 wherein the hub plate is in the shape of a figure eight.

5. The mortise lock of claim 1 wherein a plastic window shield disk is employed between the opening in the indicator and the indicator slide.

* * * * *

UNITED STATES PATENT AND TRADEMARK OFFICE

CERTIFICATE OF CORRECTION

PATENT NO. : 6,938,445 B2
DATED : September 6, 2005
INVENTOR(S) : Richard Hai Huang It is certified that error appears in the above-identified patent and that said Letters Patent is hereby corrected as shown below:

Column 6, line 60 thru Column 7, line 5,
Claim 2 should read as follows:
-- 2. The mortise lock of claim 1 wherein the indicator slide is contained in a lower rectangular recess of the housing which comprises an upper triangular recess and a lower rectangular recess, a hub plate having one end in the triangular recess and the other end in the rectangular recess, the end in the triangular recess having an opening to accommodate the indicator spindle and which spindle rotates the hub plate when the mortise lock output is rotated to lock or unlock the lock and the rotating hub plate linearly moves the indicator slide linearly horizontally sideways between the right and left sides in the rectangular recess of the housing changing the visual indicator to locked or unlocked depending on the position of the deadbolt. --.

Signed and Sealed this

Tenth Day of January, 2006

JON W. DUDAS
*Director of the United States Patent and Trademark Office*